US007979997B2

(12) United States Patent
Pianetto

(10) Patent No.: US 7,979,997 B2
(45) Date of Patent: Jul. 19, 2011

(54) CARPENTRY STUD SPACER

(76) Inventor: Nicholas Pianetto, Des Plaines, IL (US)

( * ) Notice: Subject to any disclaimer, the term of this patent is extended or adjusted under 35 U.S.C. 154(b) by 0 days.

(21) Appl. No.: 12/576,098

(22) Filed: Oct. 8, 2009

(65) Prior Publication Data

US 2011/0083336 A1 Apr. 14, 2011

(51) Int. Cl.
*G01B 3/30* (2006.01)

(52) U.S. Cl. ..... 33/613; 33/562

(58) Field of Classification Search ..... 33/613, 33/194, 518, 520, 413, 414
See application file for complete search history.

(56) References Cited

U.S. PATENT DOCUMENTS

| | | | | | |
|---|---|---|---|---|---|
| 3,059,341 | A | * | 10/1962 | Becker | 33/197 |
| D271,087 | S | * | 10/1983 | Gianos | D10/61 |
| 4,625,415 | A | | 12/1986 | Diamontis | |
| 4,843,726 | A | | 7/1989 | Ward | |
| 5,163,233 | A | | 11/1992 | Benson | |
| 5,274,973 | A | | 1/1994 | Liang | |
| 5,491,905 | A | * | 2/1996 | Jablonski et al. | 33/613 |
| 5,560,112 | A | * | 10/1996 | Stein et al. | 33/194 |
| 5,913,546 | A | | 6/1999 | Kuchenbrod et al. | |
| 6,282,852 | B1 | * | 9/2001 | Walcker | 33/194 |
| 6,694,695 | B2 | * | 2/2004 | Collins et al. | 52/568 |
| 6,810,592 | B1 | * | 11/2004 | Oldfield, Jr. | 33/194 |
| 6,990,741 | B1 | * | 1/2006 | Wells | 33/194 |
| 7,017,310 | B2 | * | 3/2006 | Brunt | 52/220.1 |
| 7,596,921 | B1 | * | 10/2009 | diGirolamo et al. | 52/696 |
| 2004/0000061 | A1 | * | 1/2004 | Tuthill | 33/194 |
| 2004/0172912 | A1 | * | 9/2004 | Brunt | 52/698 |
| 2006/0010703 | A1 | * | 1/2006 | Gauthier | 33/613 |
| 2006/0168906 | A1 | * | 8/2006 | Tonyan et al. | 52/264 |
| 2006/0277841 | A1 | * | 12/2006 | Majusiak | 52/105 |
| 2007/0234671 | A1 | * | 10/2007 | Klein | 52/474 |
| 2010/0050454 | A1 | * | 3/2010 | Mchowell | 33/613 |
| 2010/0101174 | A1 | * | 4/2010 | Orszulak et al. | 52/687 |

* cited by examiner

*Primary Examiner* — Yaritza Guadalupe-McCall
(74) *Attorney, Agent, or Firm* — Husch Blackwell, LLP; Edward J. Chalfie

(57) ABSTRACT

An apparatus for spacing studs on a plate is provided. The apparatus includes a frame, a bottom jaw, and first and second side jaws. The frame includes first and second parallelogram linkages at first and second ends thereof, and the first and second side jaws are connected to outer ends of the first and second parallelogram linkages, respectively. The bottom jaw is capable of engaging a plate, and the first and second side jaws are capable of engaging first and second studs for securing the first stud to the plate at a predetermined distance from the second stud.

12 Claims, 2 Drawing Sheets

CARPENTRY STUD SPACER

FIELD OF INVENTION

The present invention relates generally to carpentry and construction. More particularly, the present invention relates to spacing, placing, and securing wall studs when building a wall frame.

BACKGROUND

In carpentry and construction, wall studs are parallel and must be precisely spaced, placed, and secured to a base plate or top plate when building a frame for a wall. Typically, wall studs, base plates and top plates are made from lengths of 2×4 dimensional lumber, although they may be formed of bent sheet metal.

In wall frame construction known to those of skill in the art, it is often required for the studs to be spaced 16 inches on center. That is, the center of each stud is positioned 16 inches from the center of the next stud on either the base plate or the top plate. In some applications, however, construction procedures may deviate from this standard, e.g., 24 inches on center.

When securing studs to the base plates and top plates, those of skill in the art often use, for example, nails, to toenail the stud into the base plates and top plates. Toenailing is driving a nail at an angle through a piece of lumber to join to an adjacent piece. Those of skill in the art will understand that toenailing creates a strong joint between a stud and a base plate or top plate.

When a carpenter builds a wall frame he starts with a base plate and top plate secured in place. He must then precisely measure and mark the position of each stud before placing and securing the stud to either the base plate or the top plate. Often a carpenter will require an aide to hold the stud in place while the carpenter secures the stud to the base plate or top plate.

However, it would be desirable if there were a tool or apparatus that would enable a carpenter to space, place, and secure a stud to a base plate or top plate without separately measuring the distance from one stud to the next. Preferably, such a tool or apparatus would enable a carpenter to toenail the stud to the base plate or top plate while ensuring that the stud was perpendicularly oriented to the base plate or top plate.

SUMMARY OF THE INVENTION

According to one embodiment of the present invention, an apparatus for spacing studs on a plate is provided. The apparatus includes a frame, a bottom jaw, and first and second side jaws. The frame includes first and second parallelogram linkages at opposite sides thereof, and the first and second side jaws are connected to outer ends of the first and second parallelogram linkages. In some embodiments, the bottom jaw engages a plate, and the first and second side jaws engage first and second studs for securing the first stud to the plate at a predetermined distance from the second stud.

Each parallelogram linkage includes the frame, a vertical jaw and upper and lower pivotal links. In some embodiments, the upper pivotal link connects the frame to the top of the vertical jaw, and the lower pivotal link connects the frame to the bottom of vertical jaw. In other embodiments, the upper and lower pivotal links connect to the frame at middle portions along the length thereof. In either embodiment, the vertical jaw is maintained in a parallel relationship with the frame.

In preferred embodiments of the present invention, the first and second side jaws are capable of positioning the first and second studs perpendicular to the plate. In some embodiments, the bottom jaw includes a plate catch mechanism.

In some embodiments, at least one of the bottom jaw, the first side jaw, or the second side jaw includes a gripping mechanism affixed to the inner side thereof. In other embodiments, at least one of the first or second side jaw includes a bubble level.

In some embodiments of the present invention, the apparatus is formed at least in part from aluminum, aluminum allow, steel, injection molded thermoplastic, or any combination thereof.

DESCRIPTION OF THE PREFERRED EMBODIMENTS

Figure 1:
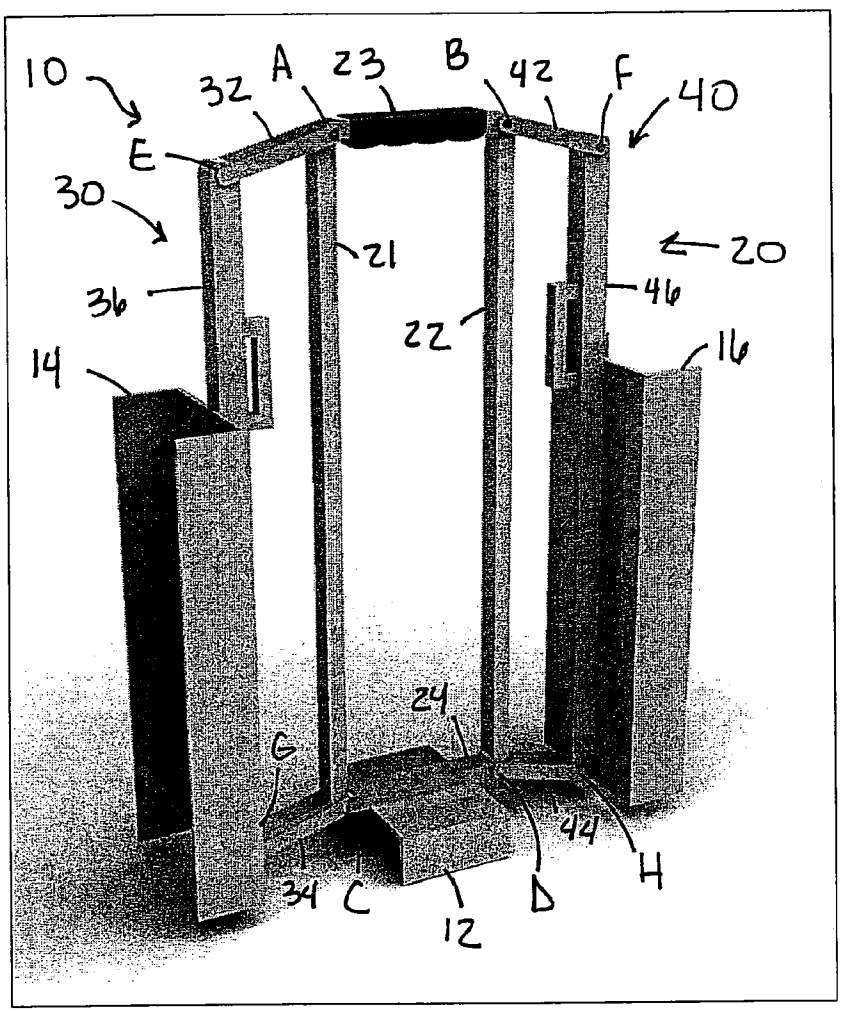
FIG. 1 is a perspective view of an apparatus in a folded position in accordance with a first embodiment of the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a tool or apparatus that enables a user to space, locate, and secure a stud to a base plate or top plate without separately measuring the distance from one stud to the next. In some embodiments, a tool or apparatus according to the present invention enables a user to toenail the stud to the base plate or top plate while ensuring that the stud is perpendicular to the plate.

FIG. 1 is a perspective view of an apparatus 10 in accordance with a first embodiment of the present invention. As seen in FIG. 1, the apparatus 10 is in a folded position. Apparatus 10 includes bottom jaw 12 and first and second side jaws 14 and 16. Each of the jaws 12, 14, 16 is an open-ended bracket dimensioned for fitting over a 2×4 plate or stud.

The frame 20 includes first and second vertical members 21, 22 that are connected by a top horizontal handle 23 at top ends thereof and a bottom horizontal member 24 at bottom ends thereof. The bottom jaw 12 is affixed or integral to the bottom horizontal member 24.

First and second parallelogram linkages 30, 40 each include top pivotal links 32, 42 and bottom pivotal links 34, 44. A first end of top pivotal link 32 is pivotally connected to a top end of the first vertical member 21 at connection point A, and a first end of top pivotal link 42 is pivotally connected to a top end of the second vertical member 22 at connection point B. A first end of the bottom pivotal link 34 is pivotally connected to a bottom end of the first vertical member 21 at connect point C, and a first end of the bottom pivotal link 44 is pivotally connected to a bottom end of the second vertical member 22 at connection point D.

A second end of top pivotal link 32 is pivotally connected to a first vertical jaw mount 36 at connection point E, and a second end of top pivotal link 42 is pivotally connected to a second vertical jaw mount 46 at connection point F. A second end of the bottom pivotal link 34 is pivotally connected to the first vertical jaw mount 36 at connection point G, and a second end of the bottom pivotal link 44 is pivotally connected to the second vertical jaw mount 46 at connection point H.

As seen in FIG. 1, connection points A and B are at top ends of respective first and second vertical members 21, 22, and connection points C and D are at bottom ends of respective first and second vertical members 21, 22. Similarly, connection points E and F are at top ends of respective first and second vertical jaw mounts 36, 46, and connection points G and H are at bottom ends of respective first and second vertical jaw mounts 36, 46.

First side jaw 14 is affixed to first vertical jaw mount 36, and second side jaw 16 is affixed to second vertical jaw mount 46. The various elements of the apparatus 10 described above are thus connected to each other in twin, opposite parallelogram linkage arrangements 30, 40 to maintain the side jaws 14,16 in parallel relationship.

Figure 2:
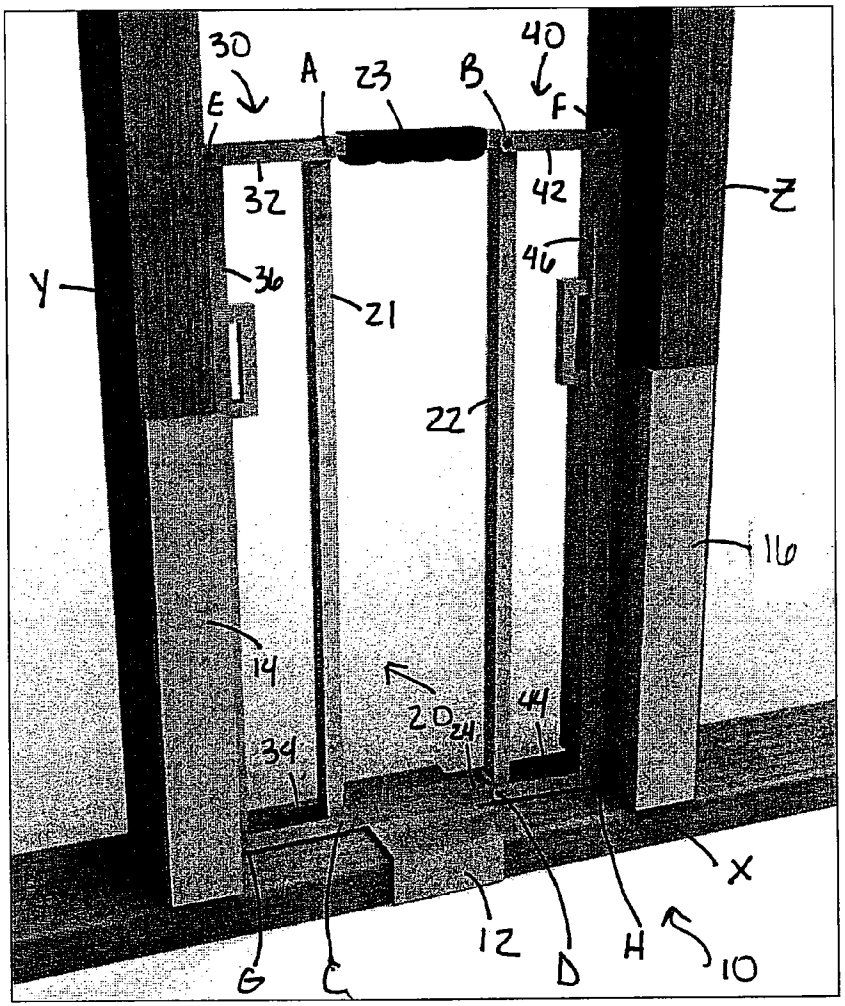
FIG. 2 is a perspective view of an apparatus in an extended position in accordance with a first embodiment of the present invention.

FIG. 2 is a perspective view of the apparatus 10 of FIG. 1 in an extended position. To move from the folded position of FIG. 1 to the extended position of FIG. 2, first and second parallelogram linkages are fully extended so that pivotal links 32, 34, 42 and 46 are horizontal.

When the apparatus 10 is in the fully extended position, the bottom jaw 12 can engage a base plate X. That is, the open end of the bottom jaw 12 can accept the base plate X in its open ended side so that jaw 12 fits around three sides of the base plate X. Similarly, the first side jaw 14 can engage a first stud Y, and the second side jaw 16 can engage a second stud Z. First and second side jaws 14, 16 act as positioning and retaining brackets to brace the studs Y, Z perpendicular to the plate X.

The dimensions of the apparatus 10 can be such that when the bottom jaw 12 engages base plate X and the side jaws 14 and 16 engage studs Y and Z, respectively, the first and second studs Y and Z are spaced 16 inches apart on center, as desired. Since 2×4 dimension lumber is actually sized 1½ inches×3½ inches, the opposite jaw faces of the side jaws 14 and 16, when fully extended, will be 14½ inches apart.

Figure 4:
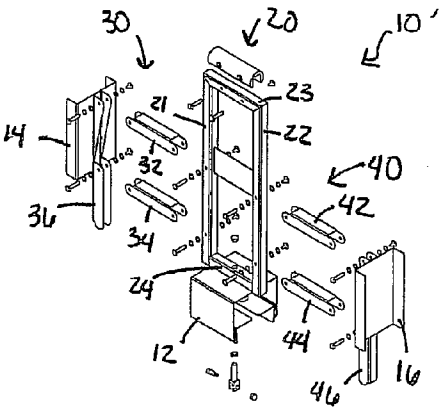
FIG. 4 is an exploded perspective view of an apparatus in accordance with a second embodiment of the present invention.
Figure 3:
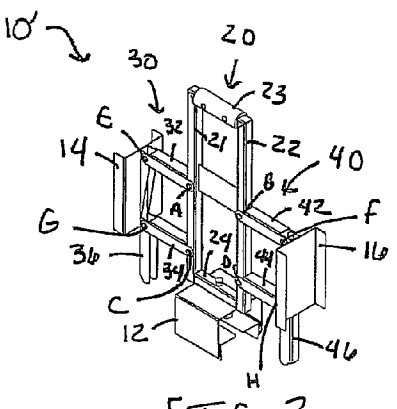
FIG. 3 is a perspective view of an apparatus in accordance with a second embodiment of the present invention.

FIGS. 3-8 describe a second embodiment of the present invention. Similar numerals are used to describe similar elements of the apparatus 10'. FIG. 3 is a perspective view of the apparatus 10' in accordance with the second embodiment of the present invention, and FIG. 4 is an exploded view of the apparatus shown in FIG. 3.

As seen in FIG. 3, a first end of top pivotal link 32 is pivotally connected to the first vertical member 21 at connection point A, which is at a middle portion along the length of the first vertical member 21. Similarly, a first end of top pivotal link 42 is pivotally connected to the second vertical member 22 at connection point B, which is at a middle portion along the length of the second vertical member 22. A first end of the bottom pivotal link 34 is pivotally connected to the first vertical member 21 at connection point C, which is also at a middle portion along the length of vertical member 21. Similarly, a first end of the bottom pivotal link 33 is pivotally connected to the second vertical member 22 at connection point D, which is also at a middle portion along the length of vertical member 22. As seen in FIG. 3, connection point A is above connection point C, and connection point B is above connection point D.

A second end of the first pivotal link 32 is pivotally connected to a top end of the first vertical jaw mount 36 at connection point E. Similarly, a second end of the first pivotal link 42 is pivotally connected to a top end of the vertical jaw mount 46 at connection point F. A second end of the bottom pivotal link 34 is pivotally connected to the first vertical jaw mount 36 at connection point G, which is at a middle portion along the length of the first vertical jaw mount 36. Similarly, a second end of the bottom pivotal link 34 is pivotally connected to the second vertical jaw mount 46 at connection point H, which is at a middle portion along the length of the second vertical jaw mount 46.

Portions of the first and second vertical members 21 and 22 extend above respective top pivotal links 32, 42 and connection points A and B. The handle 23 connects top ends of the first and second vertical members 21 and 22. Similarly, portions of the first and second vertical jaw mounts 36, 46 extend below respective bottom pivotal links 34, 44 and connection points G and H. Bottom ends of the first and second vertical jaw mounts 36, 46 can abut a base plate when engaged with the apparatus 10'.

Figure 6:
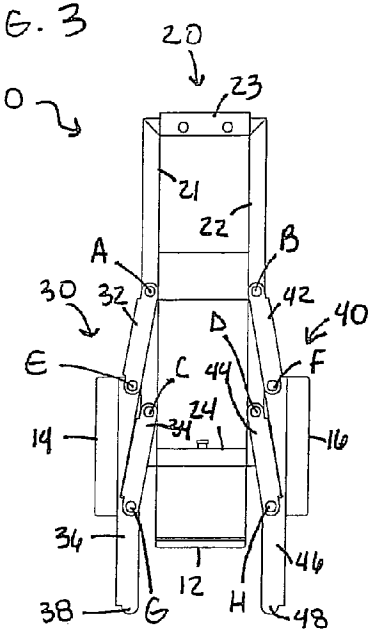
FIG. 6 is a front view of an apparatus in a folded position in accordance with a second embodiment of the present invention.
Figure 5:
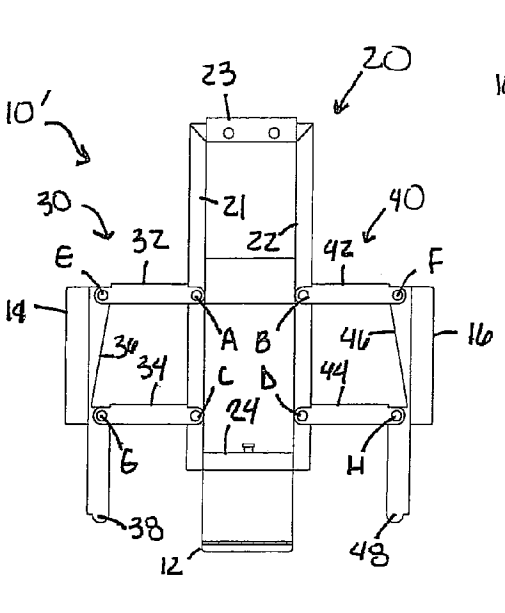
FIG. 5 is a front view of an apparatus in an extended position in accordance with a second embodiment of the present invention.

Second ends of the first and second vertical jaw mounts 36, 46 can include rounded stops 38, 48 or edges (best seen in FIGS. 5 and 6). When the apparatus 10' engages a base plate X (not shown), the rounded stops 38, 48 can abut the base plate X. Because the second ends of the first and second vertical jaw mounts 36, 46 include rounded stops 38, 48, the surface of the plate is protected from marring.

As seen in FIG. 5, the side jaws 14 and 16 extend from the top of vertical jaw mounts 36, 46 down to the bottom pivotal links 34, 44. Because jaws 14, 16 do not extend all of the way to the bottom of the vertical jaw mounts 36, 46 and to the base plate X (not shown), a user has access to the bottom ends of the studs Y, Z (not shown) that are engaged by jaws 14, 16. Accordingly, the user can secure the studs, Y, Z to the base plate X using, for example, toenailing.

FIG. 6 is a front view of the apparatus 10' of FIG. 5 in a folded position. To move from the extended position of FIG. 5 to the folded position of FIG. 6, the first and second parallelogram linkages 30, 40 pivot about connection points A, B, C, D, E, F, G, H from the perpendicular position of FIG. 5 to the folded down position of FIG. 6. That is, top pivotal link 32 pivots from a horizontal position about connection points A and E and the bottom pivotal link 34 pivots from a horizontal position about connection points C and G until the top pivotal link 32 and the bottom pivotal link 34 are relatively adjacent to the first vertical member 21. The top pivotal link 42 pivots from a horizontal position about connection points B and F and the bottom pivotal link 44 pivots from a horizontal position about connection points D and H until top pivotal link 42 and the bottom pivotal link 44 are relatively adjacent to the second vertical member 22.

As the top and bottom pivotal links 32 and 34 pivot, the first vertical jaw mount 36 pivots about connection points E and G. Similarly, as the top 42 and bottom 44 pivotal links pivot, the second vertical jaw mount 46 pivots about connection points F and H.

In embodiments of the present invention, simply lifting the apparatus 10' from a base plate X enables the apparatus 10' to collapse from the extended position (FIG. 5) to the folded position (FIG. 6). That is, gravity acts on the apparatus 10' to keep it in the folded position. Engagement with a base plate X causes the elements of the apparatus 10' to pivot as described above and move to the extended position.

Figure 7:
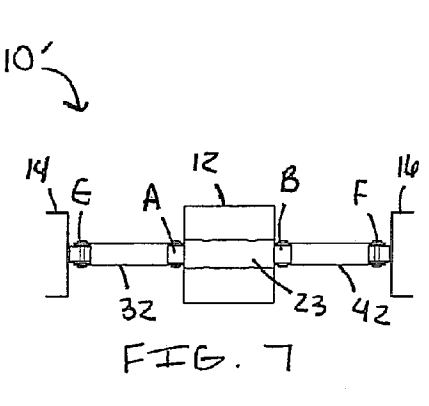
FIG. 7 is a top view of an apparatus in accordance with a second embodiment of the present invention.
Figure 8:
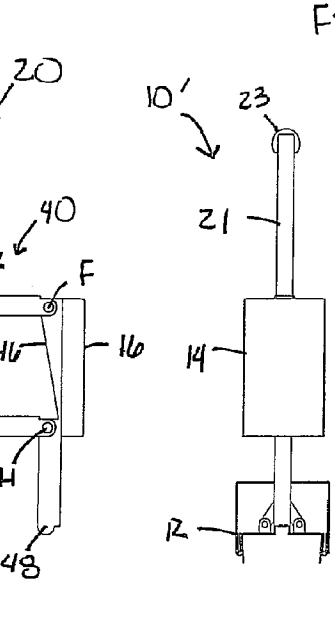
FIG. 8 is a first side view of an apparatus in accordance with a second embodiment of the present invention.

FIG. 7 is a top view of the apparatus 10' in accordance with the second embodiment of the present invention, and FIG. 8 is a first side view of the apparatus 10' in accordance with the second embodiment of the present invention. As seen in FIG. 7, the first and second side jaws 14, 16 can include open ended brackets so that studs can be fitted therein. Similarly, as seen in FIG. 8, the bottom jaw 12 can include an open ended bracket so that a base plate can be fitted therein.

The apparatus 10 or 10' described herein has been described with reference to bottom jaw 12 being engaged with a base plate of a wall frame. However, it is to be understood that jaw 12 can also be engaged with a top plate of a wall frame. When jaw 12 engages a top plate, the apparatus 10 or 10' extends in a downward direction from the top plate. The jaw 12 can include a bracket, affixing mechanism, or plate catch mechanism to secure the jaw 12 to the top plate. In some embodiments of the present invention, the jaw 12 can be spring biased so that springs push the jaw 12 inward and around the top plate. Mechanisms associated with the jaw 12 allow a user to place and secure the apparatus 10 or 10' and continue using his hands freely.

Figure 9:
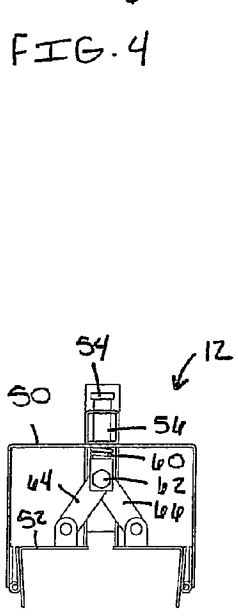
FIG. 9 is an enlarged side view of a jaw including a plate catch mechanism in accordance with the present invention.

FIG. 9 is an enlarged side view of a jaw 12 including a plate catch mechanism in accordance with the present invention. As seen in FIG. 9, plate catch mechanism of the jaw 12 can include an outer jaw 50, an inner jaw 52, a push button screw 54, and linkage connection plates 64 and 66. In a resting position, the inner jaw preferably has a width that is smaller than the width of a 2×4 dimensional piece of lumber.

When a user depresses the push button screw 54, the screw 54 engages the push button shaft 56, which engages a spring 60. The spring 60 then engages a shoulder screw 62, which engages first and second linkage connection plates 64, 66. The engaged plates 64, 66 cause the inner jaw 52 to expand so that the width of the inner jaw 52 is at least slightly larger than the width of a 2×4 dimensional piece of lumber. Accordingly, the inner jaw 52 can engage the lumber (the top plate).

Once the inner jaw 52 engages a top plate and is placed around three sides thereof, a user can release the push button screw 54. Releasing the push button screw 53 disengages the push button shaft 56, which disengages the spring 60. The spring 60 can then disengage the shoulder screw 62, which disengages the first and second linkage connection plates 64, 66. The disengaged plates 64, 66 then cause the inner jaw 52 to contract, reducing the width of the inner jaw 52. Accordingly, the inner jaw 52 fits securely and snugly around three sides of the top plate, and user intervention is not required to hold the inner jaw 52 in place.

Jaws 12, 14, 16 of the apparatus 10 and 10' shown and described herein can include gripping mechanisms affixed to the inner sides thereof. Accordingly, when studs or base or top plates are engaged with jaws 12, 14, 16, the gripping mechanisms prevent the studs or plates from slipping and ensure that the studs or plates remain securely in place.

First and second side jaws 14, 16 can also include bubble levels affixed or integral thereto. Bubble levels can ensure that the apparatus 10 or 10' is level and that bottom jaw 12 is properly engaged with a base plate or top plate.

In embodiments of the present invention, some or all of the apparatus can be made from aluminum, an aluminum alloy, steel, injection molded thermoplastic, or any combination thereof.

In methods of using the present invention, a user can start with either a base plate or a top plate secured in place. For a base plate, the user places the apparatus 10 or 10' so that the bottom jaw 12 engages the base plate X. Engaging the bottom jaw 12 with the base plate X causes the first and second parallelogram linkages 30, 40 to extend as in FIG. 5.

A user then engages a first stud Y with the first side jaw 14 and engages a second stud Z with the second side jaw 16. The user does not need to measure the distance between the first stud and the second stud to precisely place one with respect to the other. Rather, the apparatus 10 or 10' of the present invention ensures that the studs are placed at a desired predetermined distance from one another, parallel to each other, and perpendicular to the top or bottom plate.

The user can then secure the studs Y, Z to the base plate X. For example, the user can toenail the studs Y, Z to the base plate X. Accordingly, the studs Y, Z can be precisely and properly spaced apart from one another, placed in a desired position relative to one another and to the base plate, and secured to the base plate.

Then, a user can disengage the bottom jaw 12 from the base plate X. Disengaging the jaw 12 from the base plate X causes the apparatus 10 or 10' to move from an extended position to a folded position and the first and second parallelogram linkages 30, 40 to fold as in FIG. 6.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. An apparatus for spacing studs on a plate comprising:

a frame, the frame including first and second parallelogram linkages at first and second ends thereof;

first and second vertically extending members;

a top horizontal handle;

a bottom horizontal member, the top horizontal handle connecting top ends of the first and second vertically extending members, and the bottom horizontal member connecting bottom ends of the first and second vertically extending members, wherein top and bottom ends of the first parallelogram linkage are pivotally connected to respective top and bottom ends of the first vertically extending member, and top and bottom ends of the second parallelogram linkage are pivotally connected to respective top and bottom ends of the second vertically extended member;

a bottom jaw;

first and second side jaws, the first and second side jaws are connected to outer ends of the first and second parallelogram linkages, respectively, wherein the bottom jaw is capable of engaging a plate, and the first and second side jaws are capable of engaging first and second studs for securing the first stud to the plate at a predetermined distance from the second stud; and wherein the first parallelogram linkage includes a top pivotal link, a bottom pivotal link, and a vertical jaw, a first end of the top pivotal link is pivotally connected the top end of the first vertically extending member, a first end of the bottom pivotal link is pivotally connected to the bottom end of the first vertically extending member, a second end of the top pivotal link is pivotally connected to a top end of the vertical jaw, and a second end of the bottom pivotal link is pivotally connected to a bottom end of the vertical jaw.

2. The apparatus as in claim 1 wherein the first side jaw is connected to or integral with at least a portion of the vertical jaw.

3. The apparatus as in claim 1 wherein the second parallelogram linkage includes a top pivotal link, a bottom pivotal link, and a vertical jaw, a first end of the top pivotal link is pivotally connected to the top end of the second vertically extending member, a first end of the bottom pivotal link is pivotally connected to the bottom end of the second vertically extending member, a second end of the top pivotal link is pivotally connected to a top end of the vertical jaw, and a second end of the bottom pivotal link is pivotally connected to a bottom end of the vertical jaw.

4. The apparatus as in claim 3 wherein the second side jaw is connected to or integral with at least a portion of the vertical jaw.

5. An apparatus for spacing studs on a plate comprising:

a frame, the frame including first and second parallelogram linkages at first and second ends thereof;

a bottom jaw; and first and second side jaws, the first and second side jaws are connected to outer ends of the first and second parallelogram linkages, respectively, wherein the bottom jaw is capable of engaging a plate, and the first and second side jaws are capable of engaging first and second studs for securing the first stud to the plate at a predetermined distance from the second stud;

the frame comprising:

first and second vertically extending members;

a top horizontal handle; and a bottom horizontal member, the top horizontally extending handles connecting top ends of the first and second vertically extending members, and the bottom horizontal member connecting bottom ends of the first and second vertically extending members, wherein a top end of the first parallelogram linkage is pivotally connected to a first connection point along the length of the first vertically extending member, and a bottom end of the first parallelogram linkage is pivotally connected to a second connection point along the length of the first vertically extending jaw, a top end of the second parallelogram linkage is pivotally connected to a first connection point along the length of the second vertically extending member, an a bottom ends of the second parallelogram linkage is pivotally connected to a second connection point along the length of the second vertically extending jaw, wherein the first connection points and the second connection points are located along middle portions of the first and second vertically extending members.

6. The apparatus as in claim 5 wherein the bottom jaw is connected to or integral with at least a portion of the bottom horizontal member.

7. The apparatus as in claim 5 wherein the first parallelogram linkage includes a top pivotal link, a bottom pivotal link, and a vertical jaw, a first end of the top pivotal link is pivotally connected to the first vertically extending member at the first point, a first end of the bottom pivotal link is pivotally connected to the first vertically extending member at the second point, a second end of the top pivotal link is pivotally connected to a top end of the vertical jaw, and a second end of the bottom pivotal link is pivotally connected to the vertical jaw at a middle portion along the length thereof, wherein a bottom portion of the vertical jaw extends below the bottom pivotal link.

8. The apparatus as in claim 7 wherein a bottom end of the vertical jaw includes a rounded edge.

9. The apparatus as in claim 7 wherein the first side jaw is connected to or integral with an upper portion of the vertical jaw.

10. The apparatus as in claim 5 wherein the second parallelogram linkage includes a top pivotal link, a bottom pivotal link, and a vertical jaw, a first end of the top pivotal link is pivotally connected to the second vertically extending member at the first point, a first end of the bottom pivotal link is pivotally connected to the second vertically extending member at the second point, a second end of the top pivotal link is pivotally connected to a top end of the vertical jaw, and a second end of the bottom pivotal link is pivotally connected to the vertical jaw at a middle portion along the length thereof, wherein a bottom portion of the vertical jaw extends below the bottom pivotal link.

11. The apparatus as in claim 10 wherein a bottom end of the vertical jaw includes a rounded edge.

12. The apparatus as in claim 10 wherein the second side jaw is connected to or integral with an upper portion of the vertical jaw.

* * * * *